US009393167B2

(12) United States Patent
Ganel

(10) Patent No.: US 9,393,167 B2
(45) Date of Patent: Jul. 19, 2016

(54) WHEELCHAIR

(71) Applicant: Ran Ganel, Herzliya (IL)

(72) Inventor: Ran Ganel, Herzliya (IL)

( * ) Notice: Subject to any disclaimer, the term of this patent is extended or adjusted under 35 U.S.C. 154(b) by 0 days.

(21) Appl. No.: 14/362,480

(22) PCT Filed: Dec. 4, 2012

(86) PCT No.: PCT/IL2012/050503
§ 371 (c)(1),
(2) Date: Jun. 3, 2014

(87) PCT Pub. No.: WO2013/084232
PCT Pub. Date: Jun. 13, 2013

(65) Prior Publication Data

US 2014/0346745 A1 Nov. 27, 2014

Related U.S. Application Data

(60) Provisional application No. 61/567,444, filed on Dec. 6, 2011.

(51) Int. Cl.

| | |
|---|---|
| ***A61G 5/10*** | (2006.01) |
| ***A61G 5/00*** | (2006.01) |
| *A61G 5/14* | (2006.01) |
| *A61G 7/053* | (2006.01) |
| *A61G 7/10* | (2006.01) |

(52) U.S. Cl.
CPC ..... *A61G 5/1056* (2013.01); *A61G 5/00* (2013.01); *A61G 5/1002* (2013.01); *A61G 5/104* (2013.01); *A61G 7/1017* (2013.01); *A61G 5/14* (2013.01); *A61G 7/053* (2013.01); *A61G 7/1007* (2013.01); *A61G 7/1034* (2013.01); *A61G 7/1038* (2013.01); *A61G 7/1046* (2013.01); *A61G 7/1059* (2013.01); *A61G 7/1094* (2013.01); *A61G 2005/1091* (2013.01)

(58) Field of Classification Search
CPC ..... A61G 5/10; A61G 5/1059; A61G 7/1017; A61G 7/1019
USPC ..... 280/47.41, 47.38, 47.4, 79.2
See application file for complete search history.

(56) References Cited

U.S. PATENT DOCUMENTS

| | | | | |
|---|---|---|---|---|
| 2,609,862 A | | 9/1952 | Pratt | |
| 4,010,499 A | | 3/1977 | Davis et al. | |
| 4,255,823 A | * | 3/1981 | Boyer et al. | 5/87.1 |
| 4,375,840 A | | 3/1983 | Campbell | |

(Continued)

FOREIGN PATENT DOCUMENTS

| | | | |
|---|---|---|---|
| JP | 2002-301109 | A | 10/2002 |
| WO | 82/01313 | A1 | 4/1982 |
| WO | 91/12975 | A1 | 9/1991 |

OTHER PUBLICATIONS

The International Search Report for International Application No. PCT/IL2012/050503, 2 pages, mailed Mar. 10, 2013.

*Primary Examiner* — Bryan Evans
(74) *Attorney, Agent, or Firm* — Vorys, Sater, Seymour & Pease LLP

(57) ABSTRACT

Provided is a wheelchair having a frame and a wheels mounted thereto, the wheelchair including: a removable seat having a rigid mount portion, a frame mounting element rigidly coupled to the frame and configured for rigidly coupling to the mount portion, and an adjusting mechanism coupled to the mounting element for adjusting the disposition thereof with respect to the mount portion.

13 Claims, 19 Drawing Sheets

(56) References Cited

U.S. PATENT DOCUMENTS

| | | | | |
|---|---|---|---|---|
| 4,669,943 | A | 6/1987 | Zamotin | |
| 4,737,997 | A * | 4/1988 | Lamson | 5/87.1 |
| 5,112,076 | A | 5/1992 | Wilson | |
| 5,201,377 | A * | 4/1993 | Wilson | 180/6.5 |
| 5,355,538 | A | 10/1994 | Fulford et al. | |
| 5,388,289 | A | 2/1995 | Casperson | |
| 5,704,439 | A | 1/1998 | Kitahama et al. | |
| 6,086,085 | A | 7/2000 | Larsson | |
| 2008/0157501 | A1 | 7/2008 | Moller | |

* cited by examiner

WHEELCHAIR

FIELD OF THE PRESENTLY DISCLOSED SUBJECT MATTER

This presently disclosed subject matter relates to equipment for handicap people in general and in particular to a wheelchair.

BACKGROUND OF THE PRESENTLY DISCLOSED SUBJECT MATTER

A variety of wheelchairs known in the art and are adapted to serve the various needs patients, elderly people, and disabled individuals. A wheelchair typically includes a seat which is mounted on a frame. The frame is provided with means for moving thereof, such as wheels, driving mechanism and lifting mechanism. The wheelchairs can be adapted for lifting patient, assisting a patient when using the bathroom or the shower. Some wheelchairs are provided with an automatic driving or adjusting mechanism providing the patient with indecency.

U.S. Pat. No. 5,704,439 discloses an electric wheelchair includes a pair of car body support posts, each having an elbow support post, a front support post and a bottom support post. The car body support posts are formed in a U-shape with the open part directed backward, and with the elbow support post and the bottom support post arranged in parallel with one another. A bottom plate firmly connects the car body support posts side-by-side. At least one back support post is provided which can be connected to the elbow support posts at the free end thereof and can be removed therefrom. A detachable seat is supported by the car body support posts. An electric driving unit includes at least one outer box, a battery, two motors and a control box, and is provided at a front portion of the bottom support posts. A pair of electric drive front wheels are provided, each directly connected to the motors, one to the right motor and the other to the left motor, and a pair of rear wheels support the rear of the wheelchair.

SUMMARY OF THE PRESENTLY DISCLOSED SUBJECT MATTER

The presently disclosed subject matter provides a wheelchair having a frame and a wheels mounted thereto, the wheelchair comprising: a removable seat having a rigid mount portion, a frame mounting element rigidly coupled to the frame and configured for rigidly coupling to the mount portion, and an adjusting mechanism coupled to the mounting element for adjusting the disposition thereof with respect to the mount portion.

The mount portion can be at least one bar profile defined along at least one side of the removable seat and the frame mounting element includes a side profile having a track defined thereon configured for receiving and locking the bar profile therein.

The bar profile can include at least one T-section and the track can include at least one flange section such that when the bar profile is disposed inside the track, the T-section in bears against the flange section thereby locking the bar profile inside the track.

The frame mounting element and the rigid mount portion can be configured for magnetic coupling with one another. The flange section can include at least one depression so as to allow the insertion of the T-section to the track therethrough.

The adjusting mechanism can be configured to allow vertical movement of the side profile with respect to the frame.

The adjusting mechanism can be further configured to allow upward pivoting of the side profile with respect to the frame thereby adjusting the angle of the side profile with respect to the rigid mount portion.

The frame can include a vertical post and wherein the side profile can be configured to vertically slide up and down along the vertical post. The adjusting mechanism includes an automatic lifting device. The lifting device can be an electrical linear actuator.

The adjusting mechanism can include a connector member, a first end thereof is pivotally coupled to a vertical post of the frame by means of a first hinge, and a second end thereof is pivotally coupled to the side profile wherein the automatic lifting device is coupled to the connector member and is configured for vertically pivoting thereof about the first hinge. The adjusting mechanism further include a coupler extending downwardly from the connector member and slidably coupled to the lifting device thus providing the connector member with additional freedom to pivot up and down with respect to the vertical post.

The coupler can be a plate having a groove defined thereon and wherein the lifting device is coupled to a bolt slidably mounted inside the groove. The adjusting mechanism can further include a stop member configured to limit the downwardly pivoted movement of the frame mounting element.

The frame mounting element can be configured to rotate sidewardly about the axis thereof. The frame mounting element can be configured to pivot sidewardly. The side profile includes an armrest vertically mounted thereon.

The rigid mount portion can include a first and a second mount portions, one on each side of the seat; and the frame mounting element can include a first and a second mounting element each rigidly coupled to one side of the frame; and the adjusting mechanism can include a first adjusting mechanism for adjusting the disposition of the first mounting element with respect to the first mount portion, and a second adjusting mechanism for adjusting the disposition of the second mounting element with respect to the second mount portion. The first and second adjusting mechanisms can be configured for synchronous operation with one another.

The wheelchair can further include a controller for controlling the synchronous operation of the first and second adjusting mechanisms. The disposition of the first mounting element with respect to the first mount portion can be different than the disposition of the second mounting element with respect to the second mount portion.

The wheelchair can include a back support. The back support can be a removable back support and/or a rotatable back support. The back support can becoupled to the removable seat. The back support can be coupled to the frame.

The presently disclosed subject matter further provides a mounting assembly for a wheelchair having a frame and a removable seat. The assembly comprising: a rigid mount portion for coupling to the seat; a rigid mounting element for coupling to the frame, the rigid mounting element being configured for rigidly coupling to the rigid mount portion; and an adjusting mechanism configured for adjusting the disposition of the rigid mounting element and the a rigid mount portion with respect to one another.

The mount portion can be at least one bar profile configured for mounting along at least one side of the removable seat and the rigid mounting element is a side profile having a track defined thereon configured for receiving and locking the bar profile therein. The bar profile includes at least one T-section and wherein the track includes at least one flange section such that when the bar profile is disposed inside the track, the T-section in bears against the flange section thereby locking the bar profile inside the track. The flange section includes at least one depression so as to allow the insertion of the T-section to the track therethrough.

The adjusting mechanism can be configured to allow vertical movement of the side profiles with respect to the frame. The adjusting mechanism can be further configured to allow upward pivoting of the side profiles with respect to the frame thereby adjusting the angle of the side profile with respect to the rigid mount portion. The adjusting mechanism includes an automatic lifting device. The adjusting mechanism includes a connector member, a first end thereof can be pivotally coupled to a vertical post of the frame by means of a first hinge, and a second end thereof is pivotally coupled to the side profile wherein the automatic lifting device is coupled to the connector member and is configured for vertically pivoting thereof about the first hinge.

The adjusting mechanism further includes a coupler extending downwardly from the connector member and slidably coupled to the lifting device thus providing the connector member with additional freedom to pivot up and down with respect to a vertical post of the frame. The coupler can be a plate having a groove defined thereon and wherein the lifting device is coupled to a bolt slidably mounted inside the groove.

As used hereinabove the term 'wheelchair' refers to any structure having a seat and a moving mechanism, such as a manual push chair, power chair, portable scooter, shower wheelchair, etc, or a seat having a lifting mechanism.

BRIEF DESCRIPTION OF THE DRAWINGS

In order to understand the disclosed subject matter and to see how it may be carried out in practice, embodiments will now be described, by way of non-limiting example only, with reference to the accompanying drawings, in which.

DETAILED DESCRIPTION OF EMBODIMENTS

Figure 1A:
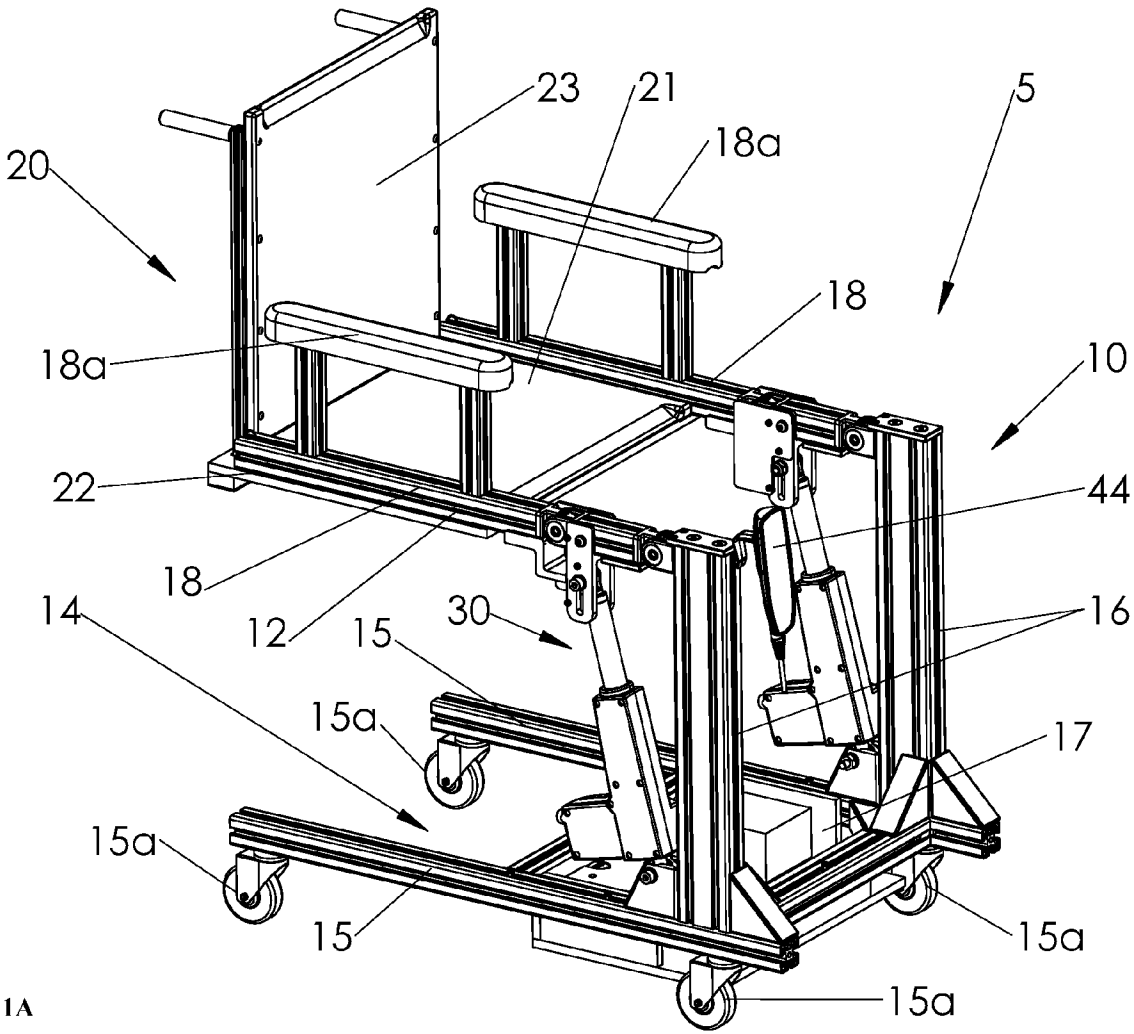
FIG. 1A is a side perspective view of a wheelchair according to one examples of the presently disclosed subject matter.
Figure 1B:
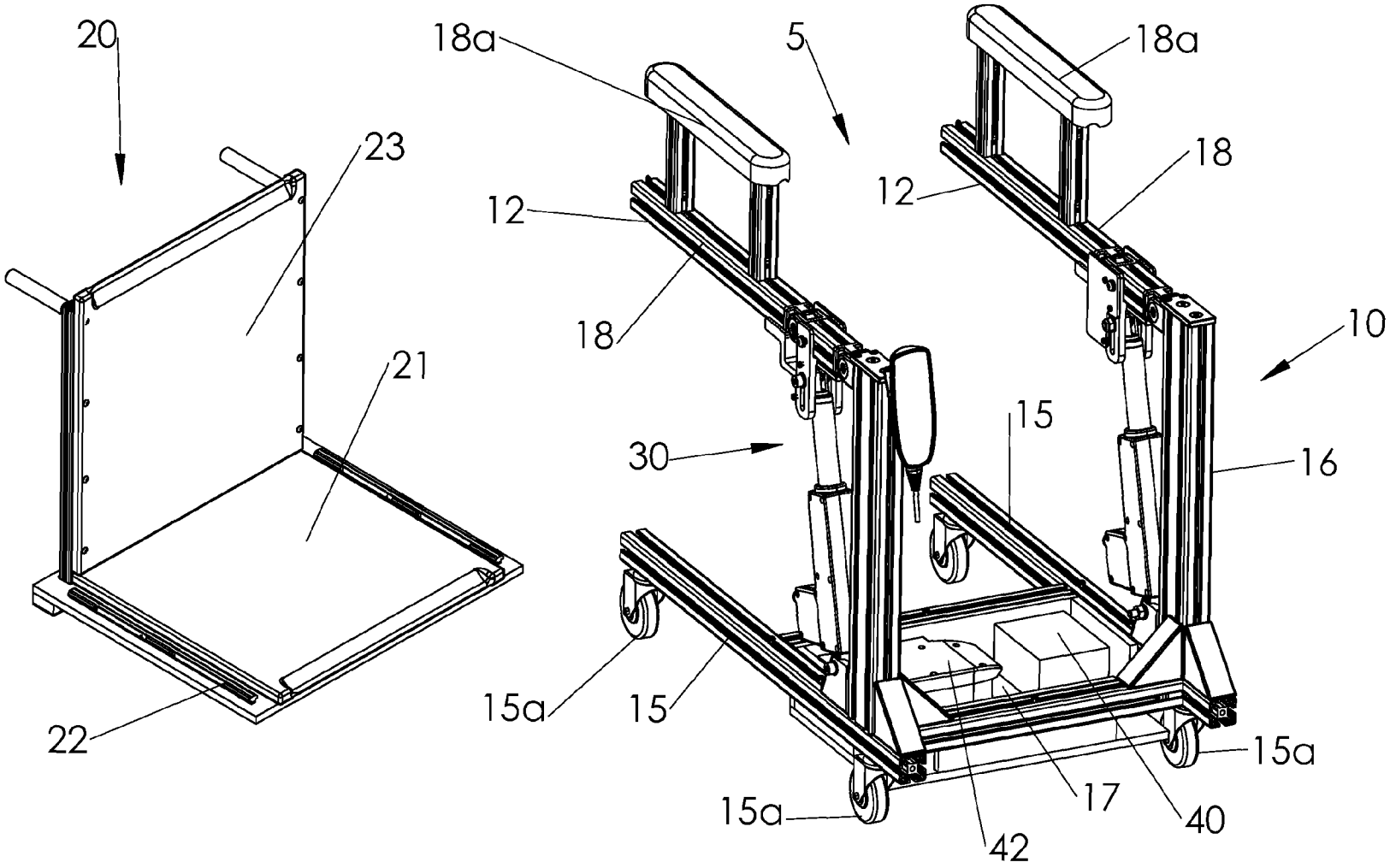
FIG. 1B is a side perspective view of a wheelchair of FIG. 1A with the seat removed.
Figure 1C:
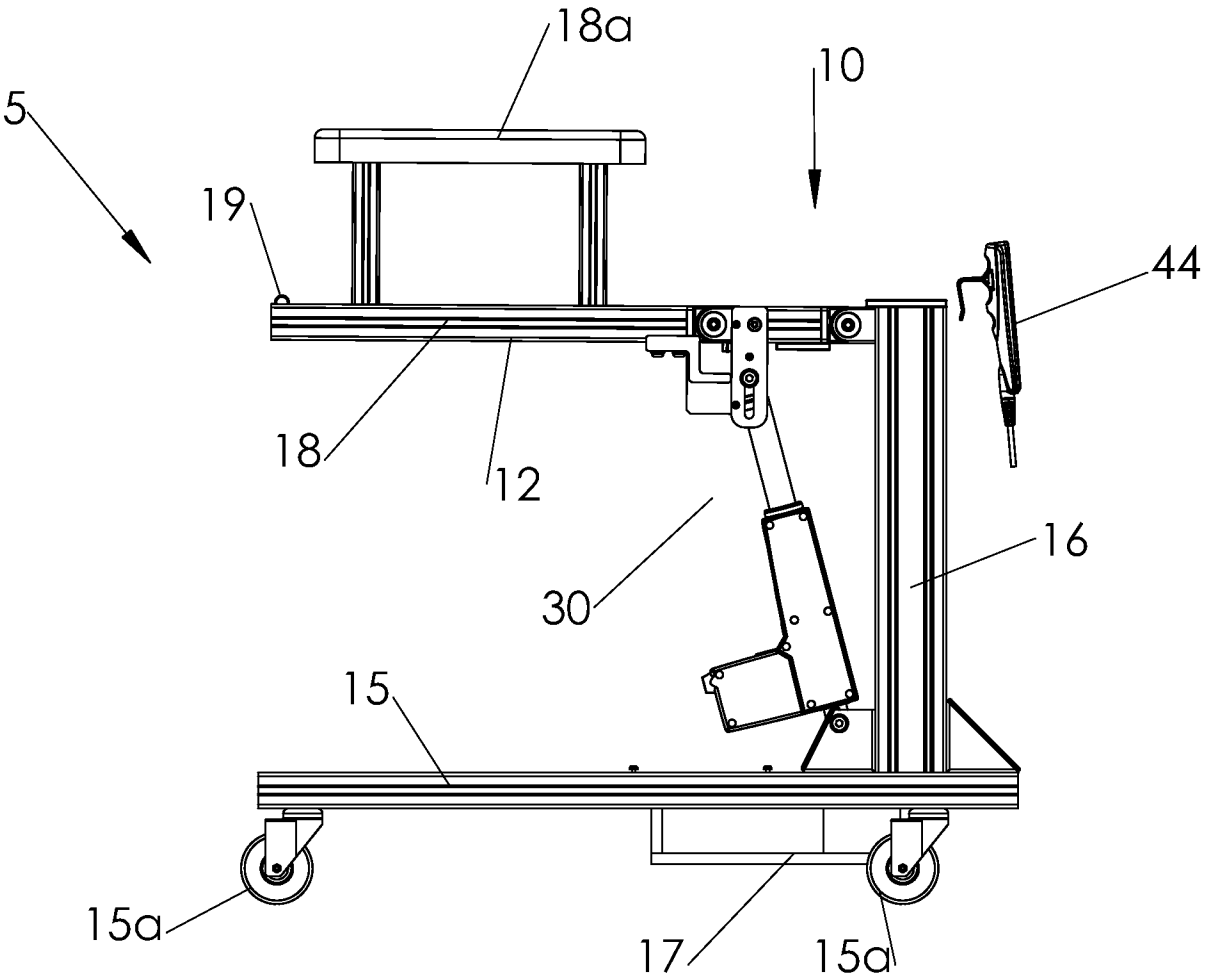
FIG. 1C is a side view of a wheelchair of FIG. 1A with the seat removed.
Figure 1D:
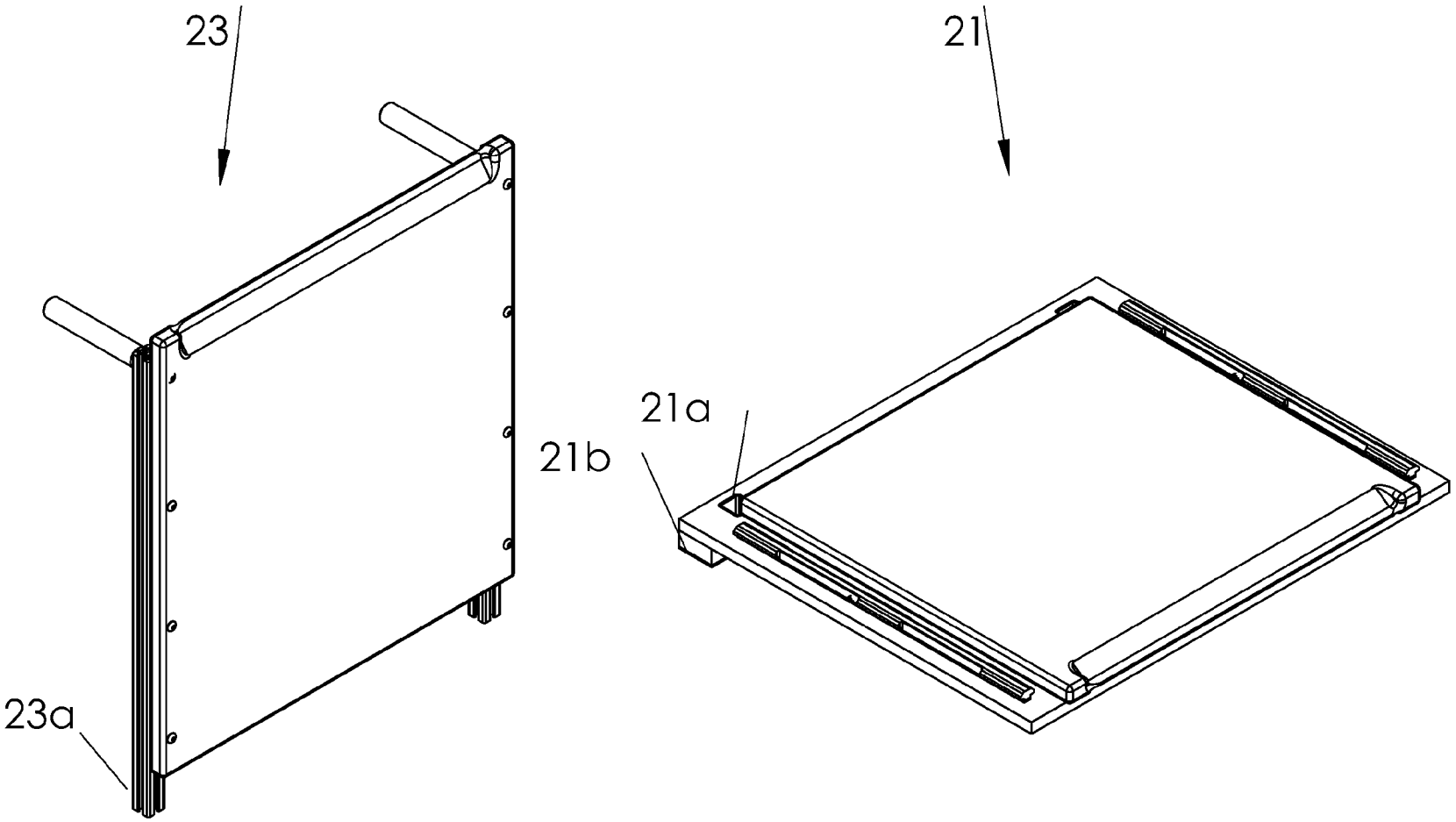
FIG. 1D is an exploded view of the removable seat.

FIGS. 1A through 1D show a wheelchair 5 having a frame 10 and a removable seat 20 mounted thereon according to one example of the presently disclosed subject matter. The removable seat 20 includes a bottom portion 21 for holding a person seated thereon, and can include a back support 23 for supporting the person's back. The removable seat 20 is provided with mount portion 22 for rigidly coupling to corresponding frame mounting elements 12 on the frame 10. As shown in FIGS. 1B, 1C and 1D the seat 20 can be removed by dismounting the mount portions 22 from the corresponding frame mounting elements 12. In order to allow mounting the seat 20 back on the frame 10, the latter is provided with an adjusting mechanism, which is generally designated 30, so as to allow adjusting the position of the frame 10 relative to the position of the seat 20. This way, the seat 20 can be mounted on the wheelchair frame 10 without having to move the seat 10, for instance, while a patient is seated thereon. According to an example, the back support 23 is removably coupled to the bottom portion 21, for example, by means of an insert 23*a* (shown in FIG. 1D) provided on the back support 23 and fitted in a corresponding opening 21*a* on bottom portion 21. Removing the back support 23 facilitate moving the person from a bed to the removable seat 20 as described in detail hereinafter.

The frame 10 can include a base 14, here illustrated as a two horizontal posts 15, coupled to a base plate 17 disposed therebetween, and having wheels 15*a* coupled thereto, a vertical post 16, and a pair of side profiles 18 for coupling to the sides of seat 20. According to this example, corresponding frame mounting elements 12 are tracks (can best be seen in FIG. 4A) defined on the bottom of the side profiles 18 configured for interlocking to mount portion 22 of the seat 20, as discussed in detail hereinafter. According to an example, each one of the side profiles 18 further include an armrest 18*a*, disposed in a desired height, or provided with a height adjusting mechanism as known.

Figure 2:
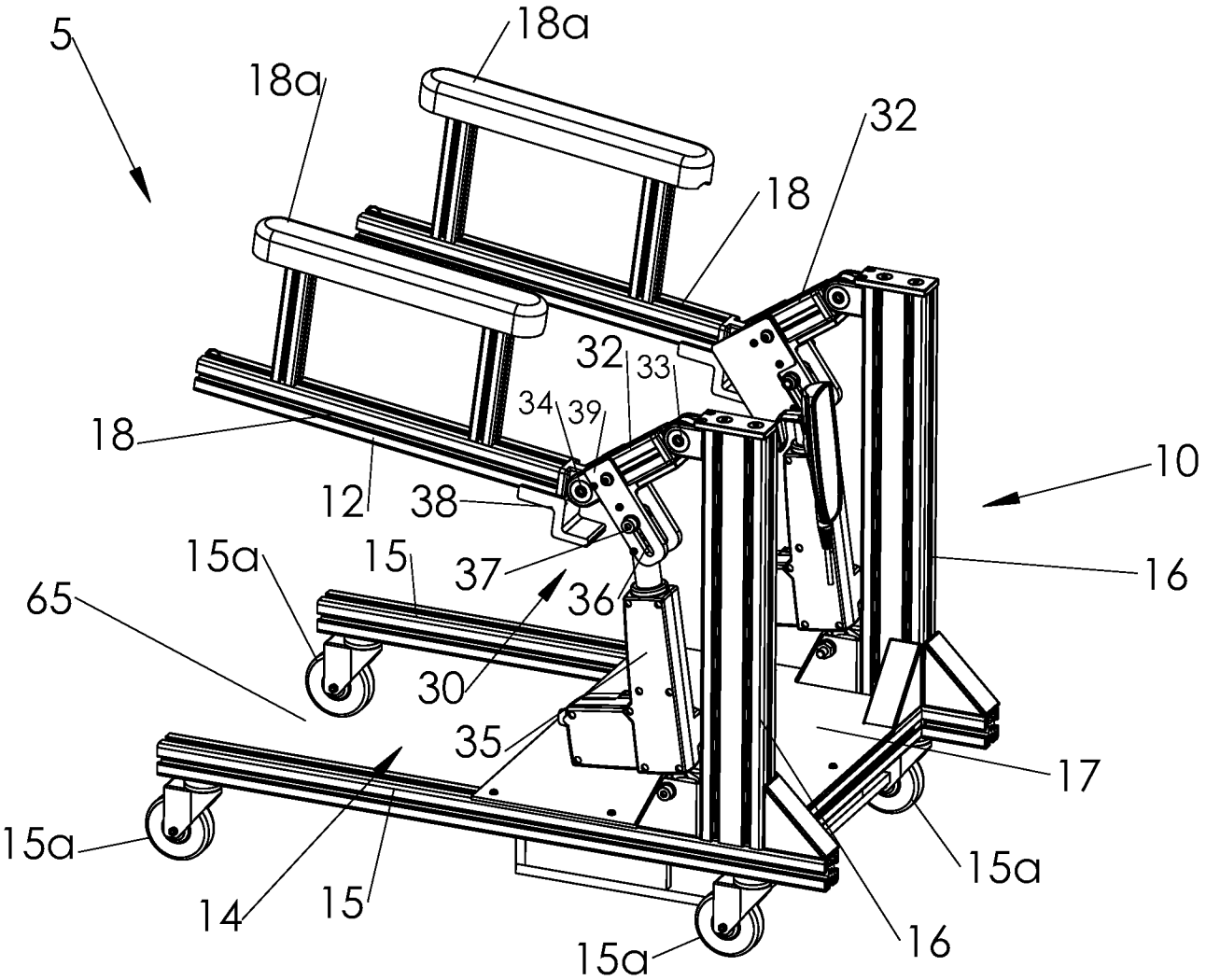
FIG. 2 is a side perspective view of a wheelchair of FIG. 1B in the retracted position.

As most clearly shown in FIG. 2, the adjusting mechanism 30, according to the illustrated example, allows vertically moving side profiles 18, as well as pivoting thereof upwardly.

Figure 3A:
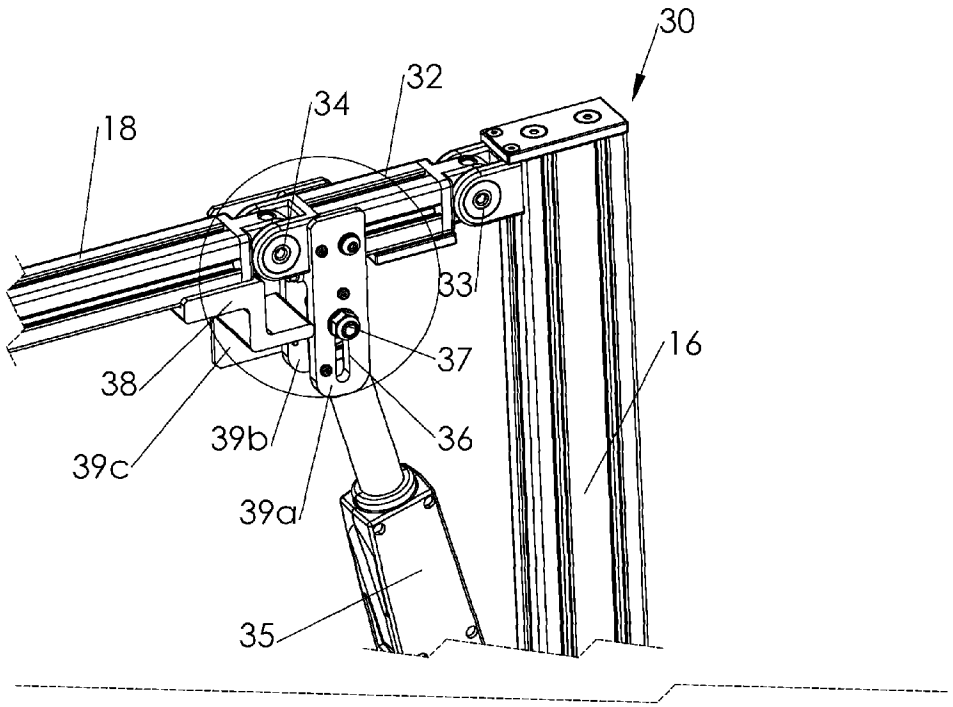
FIG. 3A is a side perspective view of an adjusting mechanism, according to an example of the presently disclosed subject matter.
Figure 3B:
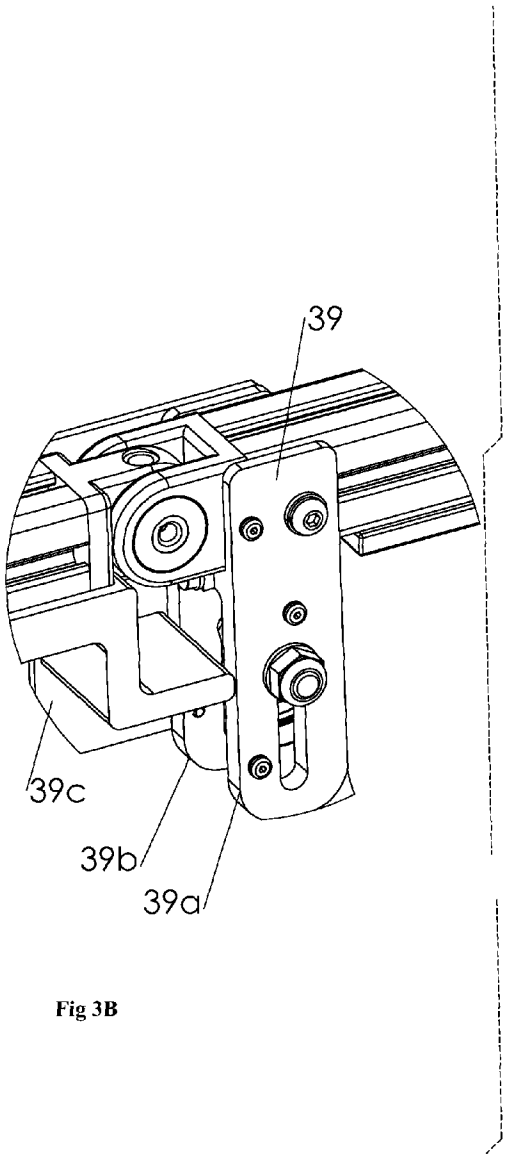
FIG. 3B is an enlarged view of a portion of the adjusting mechanism of FIG. 3A.

Reference is now made to FIGS. 3A and 3B, adjusting mechanism 30 can includes a connector member 32, one end thereof is pivotally coupled to the vertical post 16 by means of a first hinge 33, and the other end thereof is pivotally coupled to side profiles 18 by means of a second hinge 34. Adjusting mechanism 30 further includes an automatic lifting device 35, such as an electrical linear actuator or a hydraulic piston, coupled to the connector member 32 and configured to pivot it upwardly and downwardly about the first hinge 33, thereby displacing side profiles 18. The lifting device 35 can be coupled to the connector member 32 by means of a coupler having a pair of plates 39*a* and 39*b*, extending downwardly from the two sides of the connector member 32, as described in detail hereinafter.

It is appreciated that although the vertical post 16 according to the illustrated example is disposed at the front of the wheelchair frame, coupled to the front end of the horizontal posts 15, it can be otherwise disposed in the middle thereof. In any case, as explained in detail hereinafter the vertical post is disposed in such away which allows bringing at least a portion of the wheelchair frame underneath a patient bed.

The side profile 18 is substantially free to pivot upwardly about the second hinge 34. However, it is noted, that according to the present example, the movement of the side profile 18 downwardly is limited to about 180° with respect to the connector member 32. This can be carried out by a stop member 38, configured to bear against the plates 39*a*, 39*b*, in such as way that the minimum angle between the side profile 18 and the coupling plates is limited to 90°. This way, when the connector member 32 is horizontally disposed, the side profiles 18 does not pivot downwardly, and as shown in FIG. 1A, the seat 20 remains substantially in the horizontal position. It is appreciated that in case a slight backward inclination of the seat 20 is desired, the stop member 38 can be configured to limit the downward movement of the side profile 18 below 90° with respect to the plates 39*a*, 39*b*. The same holds true when a forward inclination is desired and thus, the stop member 38 can be configured to limit the downward movement of the side profile 18 for example, above 90° with respect to the plates 39*a*, 39*b*.

It is appreciated that although, for sake of simplicity, the above description is related to the adjusting mechanism 30 of one side of the frame 10, the second side thereof includes substantially the same adjusting mechanism 30 coupled thereto, i.e. having a connector member 32 pivotally coupled to the vertical post 16 and side profiles 18, and coupled to a lifting device 35. As will become apparent hereinafter, the two adjusting mechanisms are configured for synchronous operation, so as to ensure the stability of the wheelchair 5. Alternatively, the wheelchair 5 can be designed with a frame having one adjusting mechanism. For example, the frame can be provided with one vertical post, and one profile for mounting to the seat 20, thus requiring only one adjusting mechanism for adjusting the frame's position with respect to the seat.

As can be seen in FIG. 2, according to one example, the operation of the adjusting mechanism 30 is as follows: when the lifting devices 35 are in the retracted position the connector members 32 are pivoted downwardly about the hinges 33, thereby lowering the side profiles 18 coupled thereto. The side profiles 18 can be pivoted upwardly so as to bring them to the desired angle with respect to the removed seat (not shown). This way if the seat is disposed on the bed and is slightly forwardly inclined as a result of the weight of the patient sitting thereon the side profile can be disposed at the same angle.

Referring back to FIGS. 3A and 3B, the plates 39*a* and 39*b*, according to one example, are each provided with a groove 36 inside which a bolt 37, coupled to the arm of the lifting device 35, is fastened. The bolt 37 is free to slide inside the groove 36, thereby providing the connector member 32 with additional freedom to pivot up and down. This feature allows the lifting device 35 to be retracted without further lowering the side profile 18, for instance when the side profiles 18 engage a bed and further lowering thereof is not desired. Accordingly, the lifting device 35 can be further retracted and the bolt 37 can slide downwardly inside the groove 36 while the plates 39*a*, 39*b*, and consequently the connector member 32 and the side profile 18, remain in place. In addition, this feature allows the side profile 18 of one side of the frame 10 to be lowered while downward movement of the other one is limited, for example, by a bed. The plates 39*a*, 39*b* as well as the stop member 38 can be covered with a cover 39*c* (here shown only with respect to one side of adjusting mechanism 30), so as to preclude possible finger trapping injuries.

It is appreciated that according to another example the coupler includes only one plate having a groove 36 defined thereon. Alternatively, the connector member can be coupled to a coupler slidably coupled to the lifting device, thus providing the connector member 32 with additional freedom to pivot up and down.

It is appreciated that the adjusting mechanism can include other arrangements allowing the position of the side profiles 18 to be adjusted and disposed substantially in parallel to the mount portion 22 on the seat 20, thereby allowing rigidly coupling thereof to the frame 10.

Figure 4A:
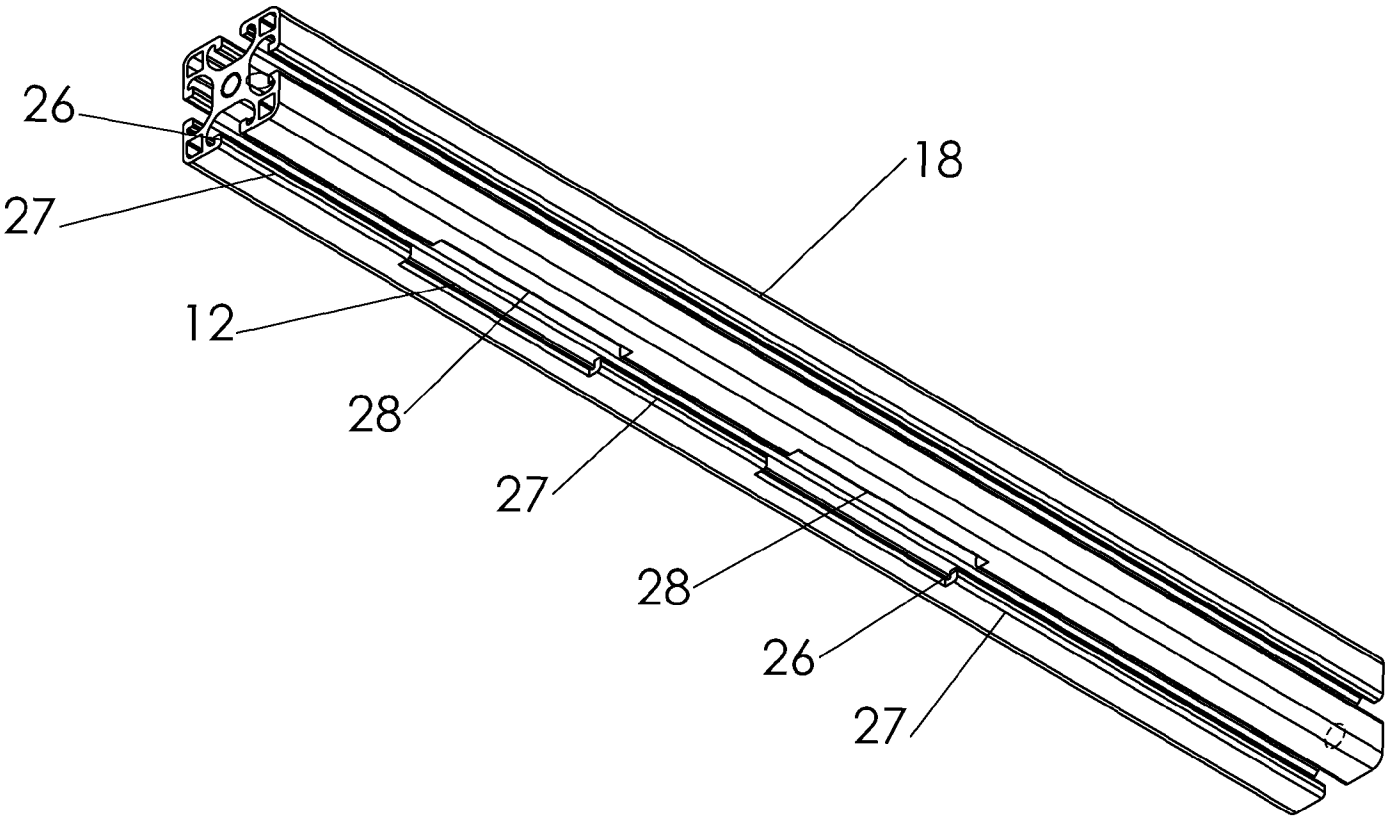
FIG. 4A is a side perspective view of a side profile having corresponding frame mounting elements according to an example of the presently disclosed subject matter.
Figure 4B:
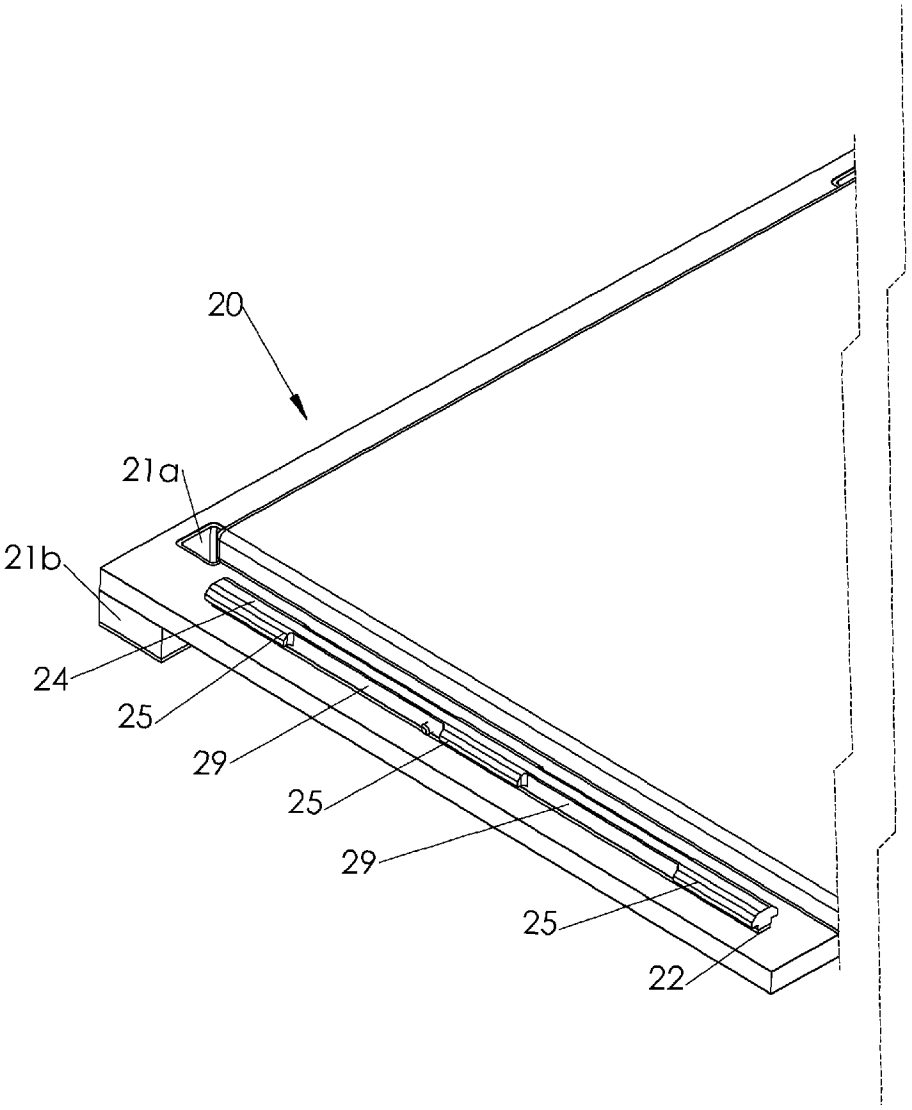
FIG. 4B is a top perspective view of the mount portion on the seat of FIG. 1A, according to an example of the presently disclosed subject matter.
Figure 5A:
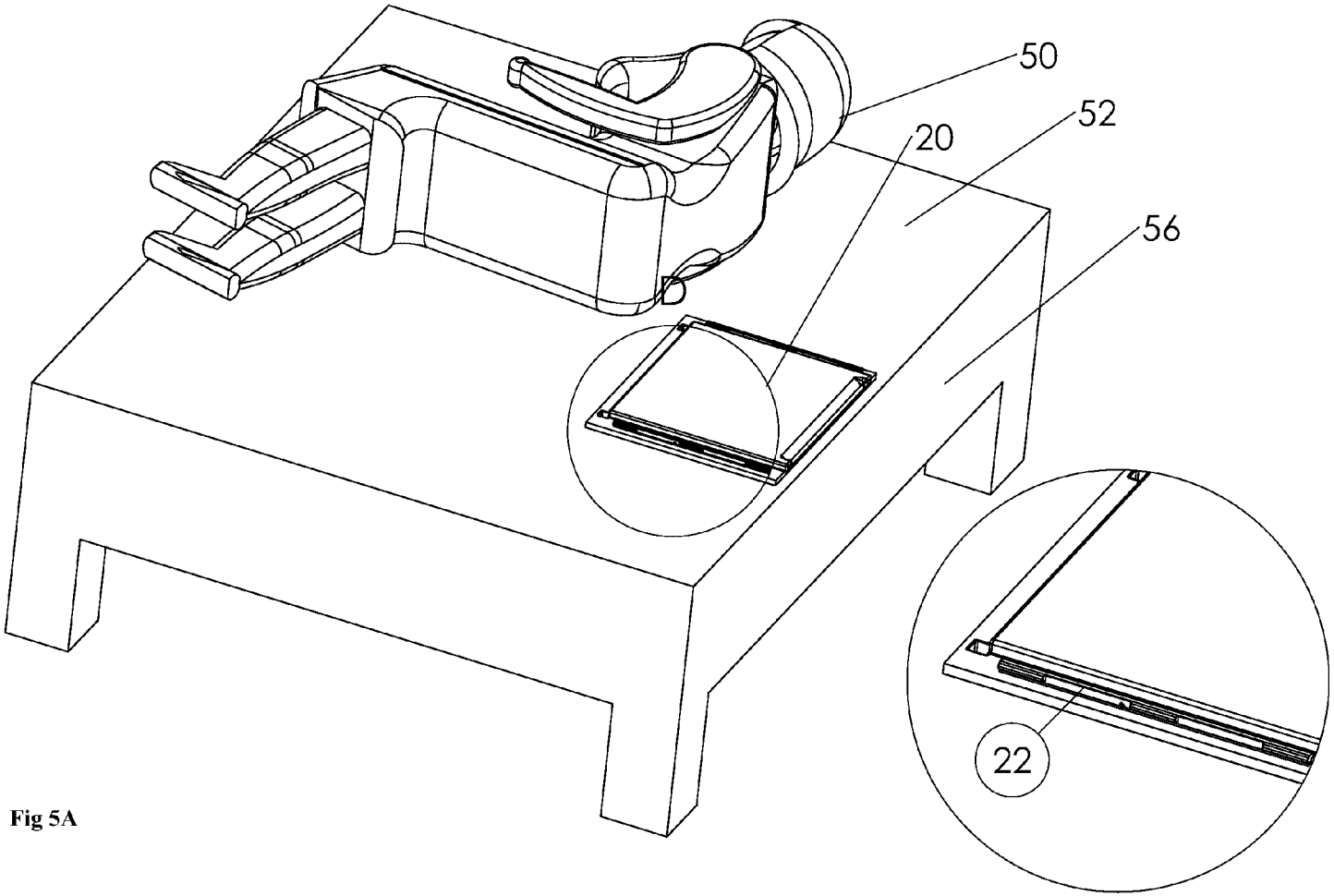
FIG. 5A is a side perspective view of a patient lying on a bed with the removable seat of FIG. 1A disposed on the bed in a first position.
Figure 5B:
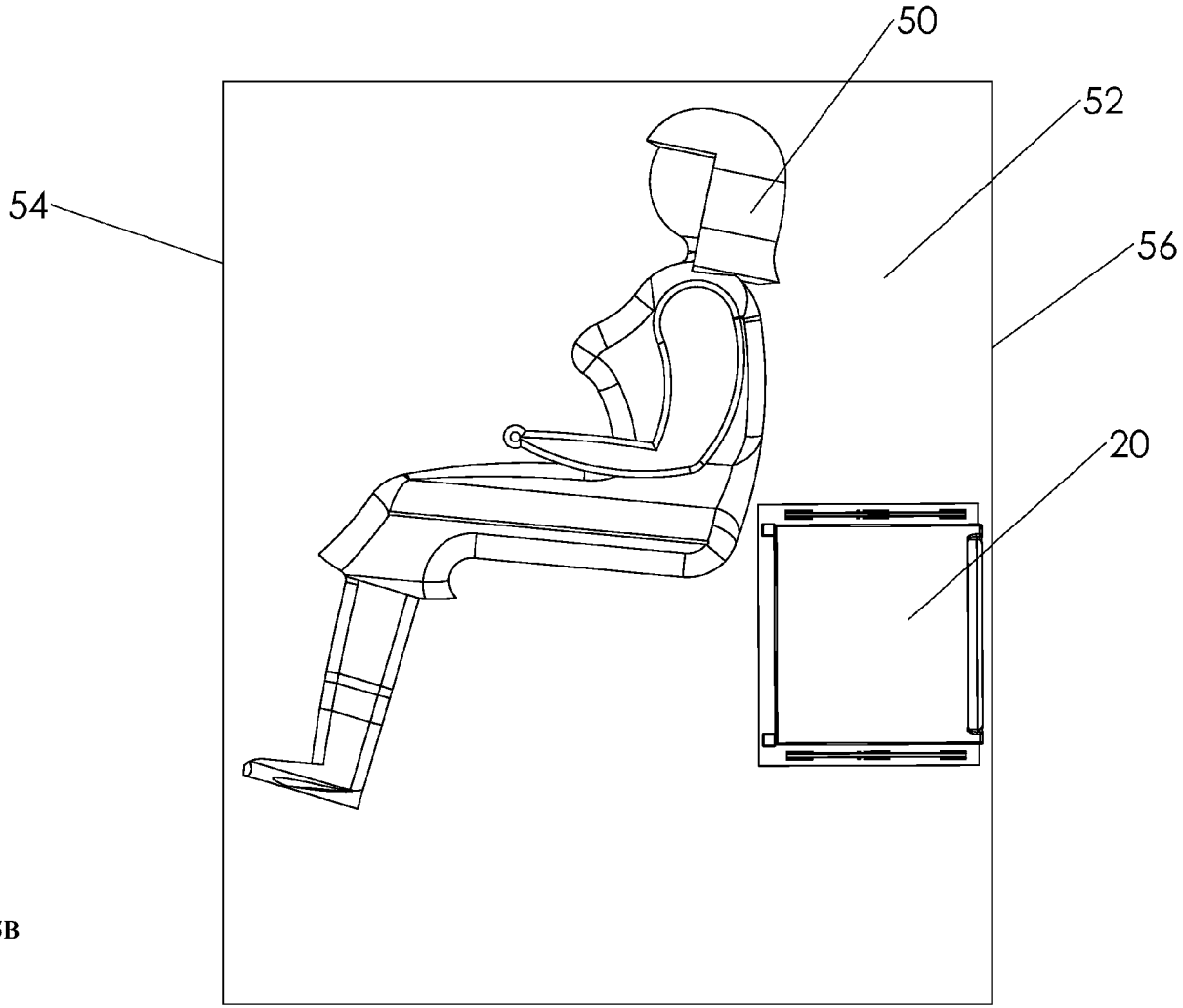
FIG. 5B is a top view of a patient lying on a bed in the position of FIG. 5A.
Figure 5C:
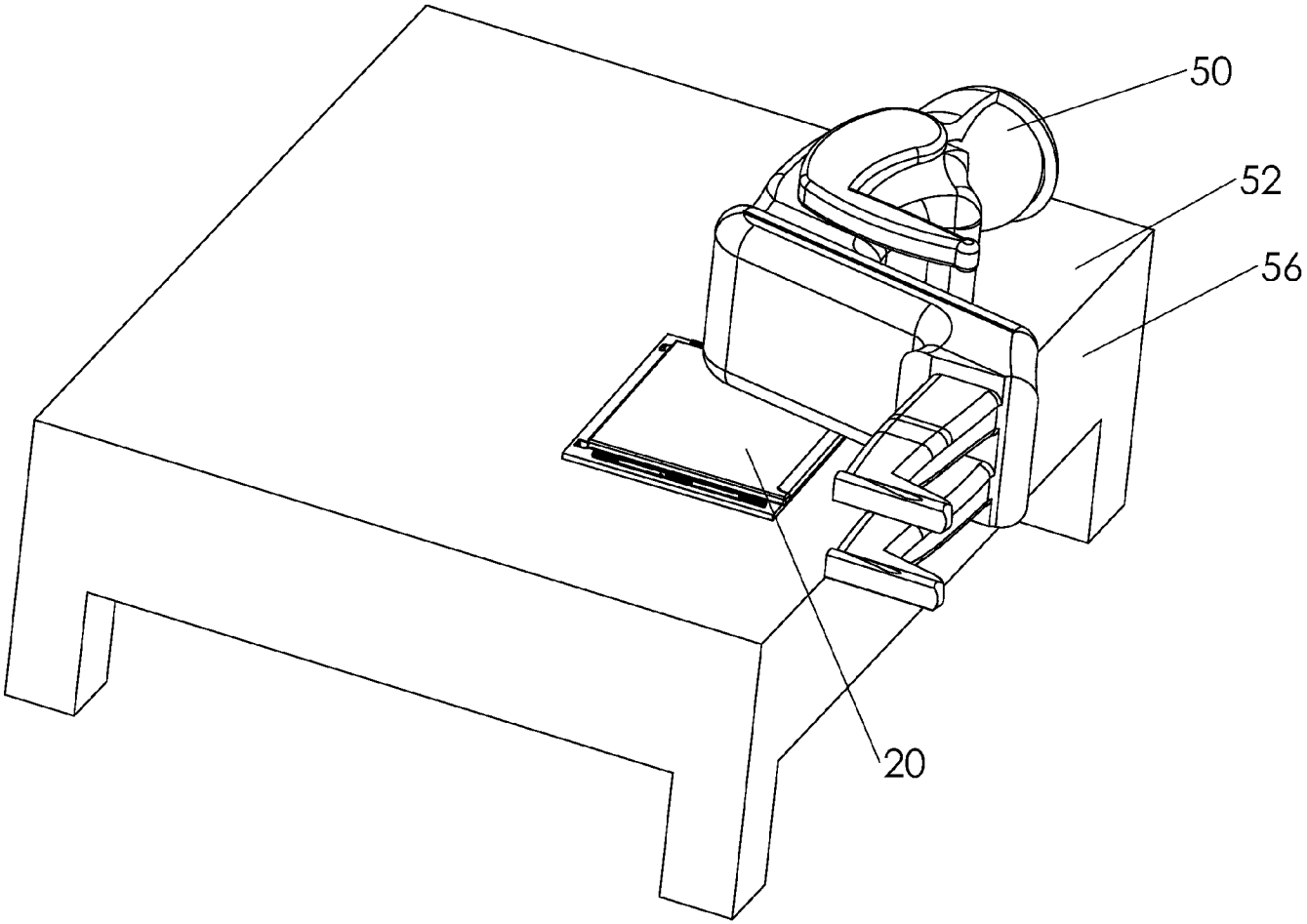
FIG. 5C is a side perspective view of the patient lying on the bed in a second position.
Figure 5D:
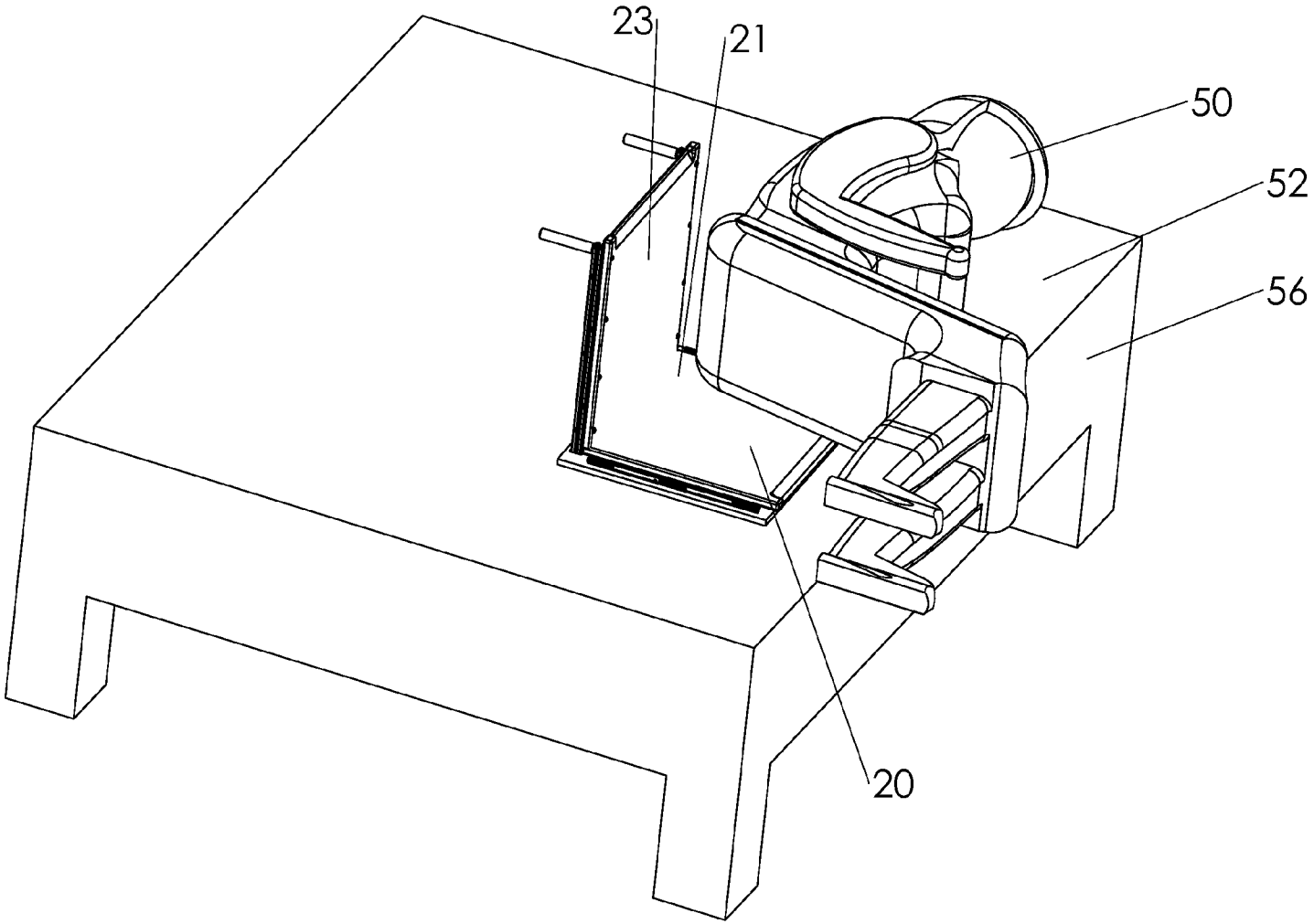
FIG. 5D is a side perspective view of the patient lying on the bed in the position of FIG. 5C with the back support mounted to the removable seat.

Referring now to FIGS. 4A and 4B, the seat 20 and the side profile 18 are configured to be fastened to one another by means of mount portions 22 and corresponding frame mounting elements 12, respectively. According to an example, the mount portion 22 includes a bar profile 24 coupled along the sides of the seat 20, and configured to slide into a corresponding track 26 defined on the side profile 18, thereby fastening the seat 20 thereto. The track 26 can be integrally formed with the side profile 18 or mounted thereon. The bar profile 24 includes a T-section 25 defined along portions of the length thereof, and similarly the track 26 includes a flange section 27 defined along the length thereof. It is appreciated that the flange section 27 and T-section 25 do not have to be defined along the entire length of the bar profile 24 and the track 26, respectively. Rather, the T-section 25 can be defined only along portions of the bar profile 24, defining open portion 29 therebetween. Similarly, the flange section 27 can include one or more depressions 28 for inserting the T-section 25 into the track 26 therethrough. This way, the bar profile 24 can be placed inside the track 26 by positioning the side profile 18 on top of the bar 24, aligning the T-sections 25 thereof with the depressions of the track 26 thereby facilitating mounting the bar profile 24 inside the track 26. Once the bar profile 24 is seated inside the track 26, the side profile 18 can be slide forward, brining the T-sections 25 into alignment with flange section 27 of the track 26, thereby locking the T-sections 25 inside the track 26 and, fastening the bar profile 24 to the side profile 18.

In order to secure the bar profile 24 to the side profile 18 a locking pin 19 (shown in FIG. 1C) can be provided, for example, on the side profile 18. The locking pin 19 can be spring biased, and can be configured to allow the side profile 18 to slide forward only, as known. That is to say, the side profile 18 can slide forward and engage the pin 19 when reaching the desired position with respect to the bar profile 24, however, the side profile 18 cannot move backward with respect to the bar profile unless the pin 19 is removed. This way the side profile 18 can be easily mounted to the bar profile 24, and is secured in place until the pin 19 is removed.

It is appreciated that the adjusting mechanism 30 can be configured to allow movement of the side profiles 18 in other directions, for example, to rotate sidewardly. In case the bar profile 24 on the seat 20 is inclined sidewardly, and thus the T-section 25 is not in parallel with the track 26 on the side profile 18, rotating the side profile sidewardly brings them back to be parallel with respect to one another. Alternatively, compensating for a slight sideward inclination of the bar profile 24 can be carried out by forming the track 26 with width, which is slightly larger than the width of the T-section 25, thus, allowing mounting thereof even when disposed slightly in an angle with respect to the side profile 18. In addition, it is appreciated that compensating for any deviation in the alignment between bar profile 24 and the track 26 can be carried out by adapting the dimensions thereof, as known. It is further appreciated that the adjusting mechanism 30 can be adapted and configured operating with various beds having different standard heights.

Referring back to FIG. 1B, according to an example the adjusting mechanism can be electrically controlled. Accordingly, the wheelchair 5 can further include a power source 40, such as a rechargeable battery, for the operation of the lifting device 35, and a controller 42 for controlling the operation of thereof. The power source 40 and the controller 42 can be placed on the base plate 17, and can be covered to prevent damage thereto and for holding the feet of the person sitting on the wheelchair 5. In addition, the wheelchair 5 can include a portable keypad 44 coupled to the controller, allowing the user seating on the wheelchair 5 or his/her assistant to operate the lifting device 35 and the adjusting mechanism 30. The portable keypad 44 can have a wireless transducer for wireless communication with the controller 42.

It is appreciated that the base plate can be of any size, that is to say, it can be replaced with a base plate having a smaller width. This way the frame can be used for a seat of a smaller size, for example, a kid wheelchair. Similarly, the wheelchair can be provided with a interchangeable front profile the length of which determines the distance between the horizontal posts 15, and thus seats of various sizes can be mounted on the frame.

FIGS. 5 through 8 illustrate the operation of the wheelchair 5 of FIG. 1, according to one example of the presently disclosed subject matter. As illustrated in FIGS. 5A through 5D, firstly, the patient is seated on the removable seat 20, while the latter is in its removable position and is placed on the patient's bed 52. The patient 50 lying on the bed 52 is rolled on his/her side facing the side 54 of the bed 52, and the seat 20 is placed between the opposite side 56 of the bed and the back of the patient, such that the bottom portion 21 is positioned close to his/her thighs, however with the mount portion 22 of one side of the bottom portion being close to his/her lower back over the pelvis (best shown in FIG. 5B). Next, as shown in FIG. 5C the patient is rolled over to the other side this time facing the opposite side 56 of the bed 52. In this position his/her thighs are positioned on the bottom portion 21 of the seat 20 and the pelvis is positioned over the mount portion 22 of one side of the seat. According to the illustrated example, when the seat 20 is placed on the bed 52, the back support 23 is removed thus facilitating rolling the patient over the bottom portion 21. Accordingly, when the patient is rolled over the bottom portion 21 the corresponding openings 21*a* are maintained exposed thus allowing fitting insert 23*a* of the back support 23 therein, thereby mounting the back potion, as shown in FIG. 5D. The back support 23 according to another example can be pivotally mounted on the seat 20, such that it can be pivoted downwardly on the bed, thus allowing the patient to be rolled onto the seat. Alternatively, the back support can be pivotally and/or detachably mounted on the frame 10, for example on the two side profiles 18. This way when it is desired to mount the seat to the frame while the patient is sited thereon, the back support 23 can be removed and detached form the side profiles 18, or it can be decoupled from one of the side profiles 18 and sidewardly rotated about the opposing side profile 18. This way the frame can be drawn adjacent to the seat while the patient is seated thereon.

It is appreciated that the patient's knees can be bent at this point or before being rolled over the bottom portion 21. Securing the inserts 23*a* inside the opening 21*a* can be carried out in any known manner. It is appreciated that in order to further secure the back support 23 to the bottom portion 21 a strip band (not shown) can be stretched between the back support 23 and an anchoring point on the armrests 18*a*.

Figure 6A:
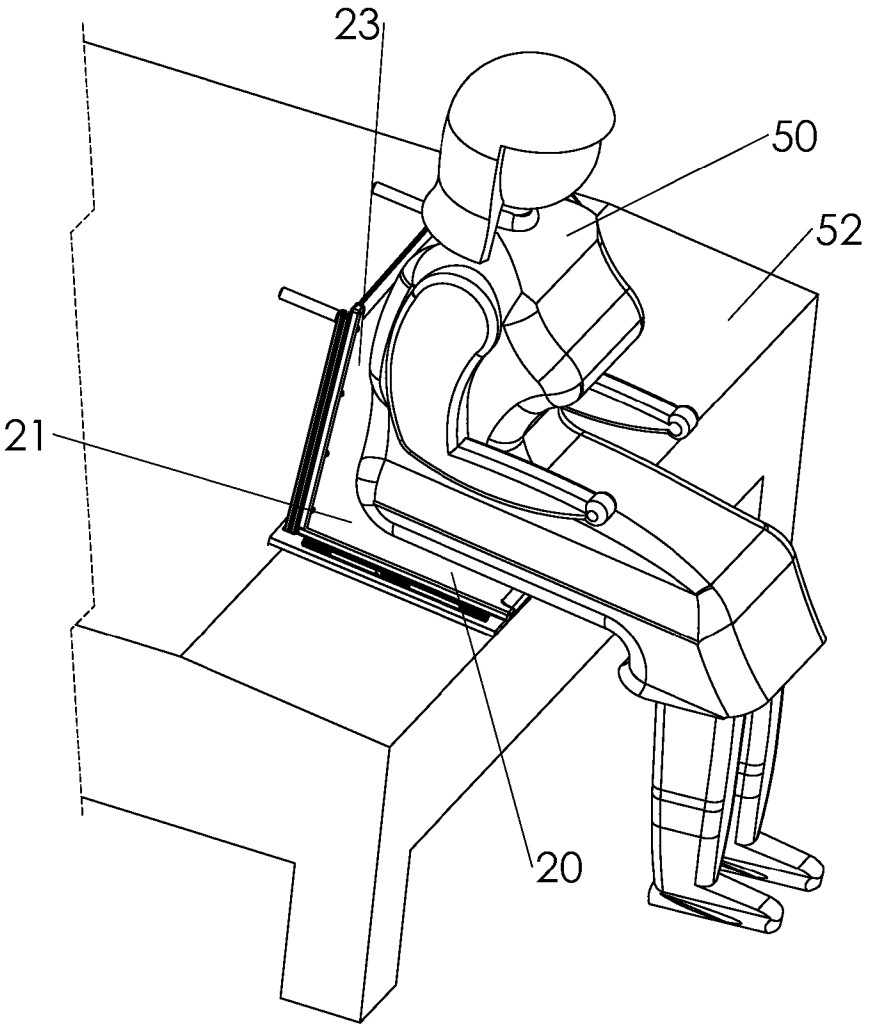
FIG. 6A is a side perspective view of a patient seated on the removable seat of FIG. 1A which is disposed on the bed.
Figure 6B:
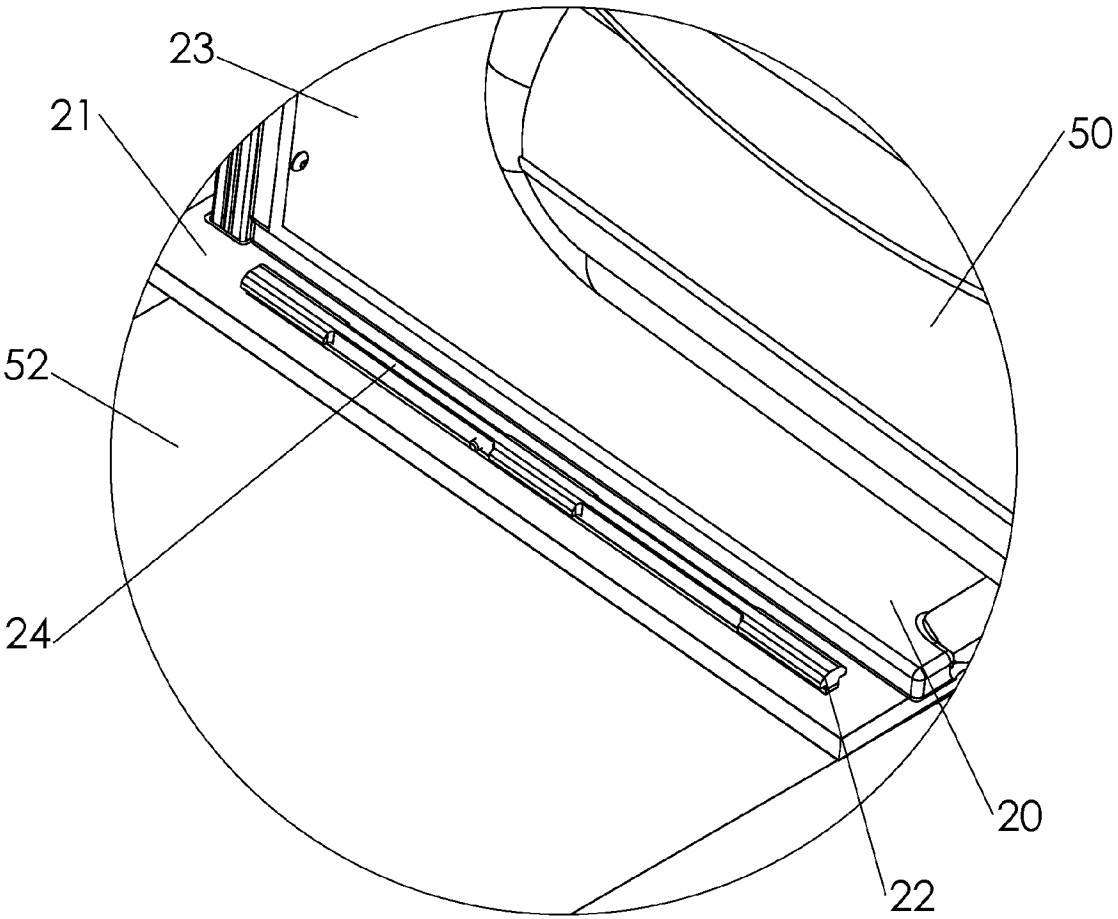
FIG. 6B is an enlarge view of a the mount portion of the removable seat of FIG. 1A.

As shown in FIG. 6A at this point the upper body of the patient 50 is lifted up, until the bottom of the patient is disposed on the bottom portion 21 of seat 20. Lifting the patient can be carried out manually or alternatively by inclining the bed upwardly, for example by actuating electronic means as known in hospital bed. In order to allow coupling of the mount portion 22 to the corresponding mounting element 12 on the wheelchair frame 10, the patient is seated on the bottom portion 21 only, disposed between the two mount portion 22, thus allowing accesses thereto. Accordingly, since when the patient is lying over one of the mount portions 22 his/her pelvis cover one side of the bottom portion 21, as described hereinabove, when he/she is lifted to the sitting position the thighs are positioned between the two mount portions 22, and the latter can be engaged by the corresponding frame mounting elements 12 of the frame 10.

Figure 7B:
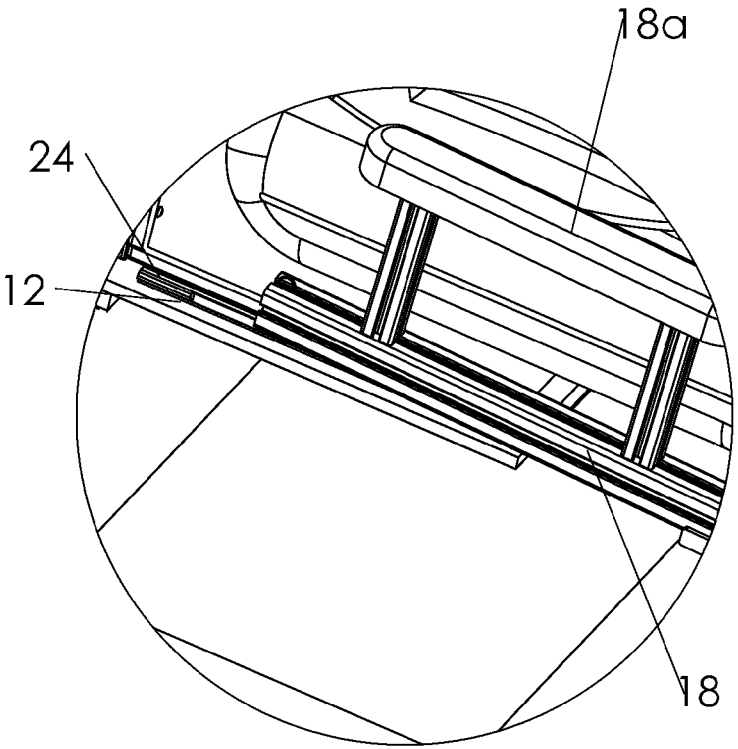
FIG. 7B is an enlarge partial view of the frame and the frame mounting elements in the position of FIG. 7A.
Figure 7A:
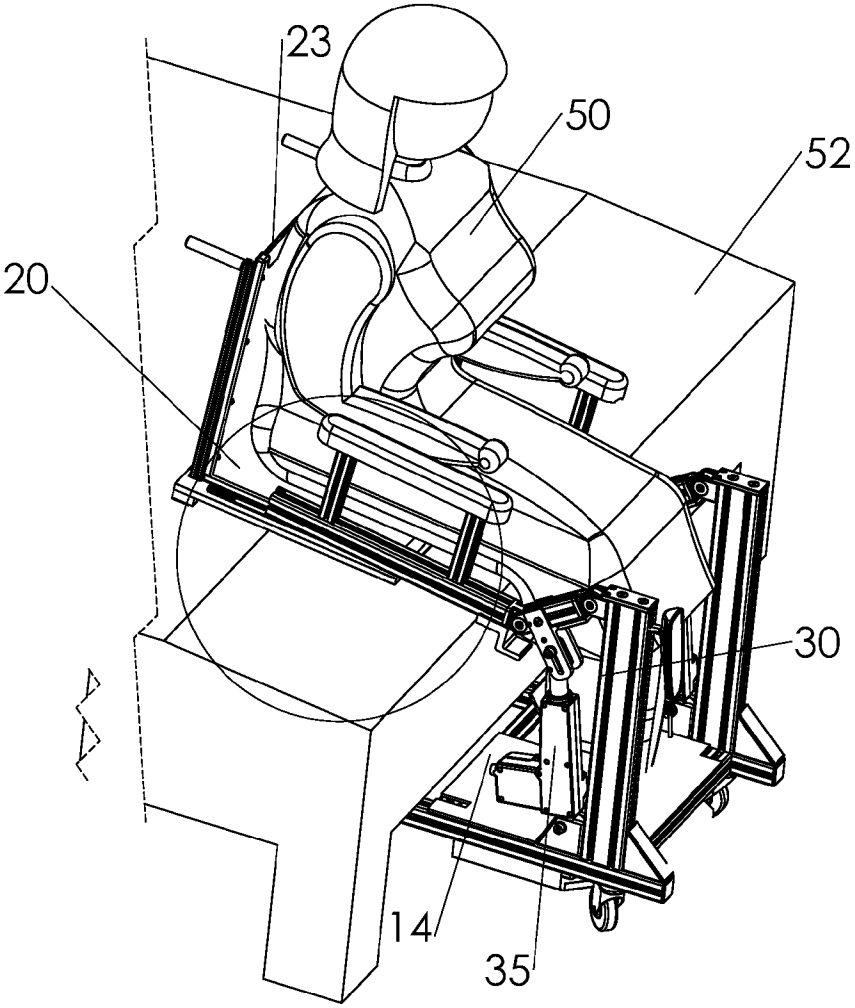
FIG. 7A is a side perspective view of the wheelchair of FIG. 1A with the frame being adjusted to be coupled to the removable seat of FIG. 6A.

As shown in FIG. 7A, the wheelchair frame 10 is moved toward the bed 52, until the base 14 is positioned under the bed, and the side profiles 18 are disposed with substantial alignment with the frame mounting elements 12, on the seat 20, i.e. the side profiles 18 are aligned with the bar profiles 24. At this point due to the weight of the patient 50 the edge of the mattress on the bed 52 may sink, thus the seat 20 is inclined forward with respect to the floor. However, the adjusting mechanism 30 on the wheelchair frame 10 allows adjusting the position of the corresponding frame mounting elements 12, so it can be fastened to the mount portions 22 on the seat 20. According to the present example, as shown in FIG. 7A, the lifting device 35 is moved to its retracted position, lowering the side profiles 18 to the height of the bed 52. The side profiles 18 are free to pivot upwardly about the second hinge 34, thus while lowering the side profiles 18, a portion thereof can engage the bed allowing only one portion thereof to be lowered, giving rise to an angle with respect to the floor, which is substantially similar to the angle of the seat 20 with respect to the floor, caused by the inclination of the mattress.

Once the side profiles 18 fully engage the bar profiles 24 the patient, or his assistant, slide the T-section 25 into the track 27 on the side profiles 18, until locking thereof by the locking pin 19. As explained hereinabove, this can be carried out by aligning the T-sections 25 with the depressions defined on the track 26, and thereafter sliding the side profile 18 forward, bringing the T-sections 25 into alignment with flange section 27 of the track 26 thereby fastening the bar profile 24 to the side profile 18. At this position the patient can rest his arms on the armrest 18*a* that are connected to the side profiles 18.

It is appreciated that the lifting device 35, the second hinge 34, as well as the wheels 15*a* on the base 14, allows the user to adjust the position of the side profiles 18 with respect to the bar profiles 24, by moving the entire wheelchair frame 10 forward toward the bed, and sideward until the two side profiles 18 are positioned substantially above the two bar profiles 24. Bringing the side profiles 18 to the desired height and angle with respect to the bar profile is carried out by activating the adjusting mechanism 30.

Figure 8:
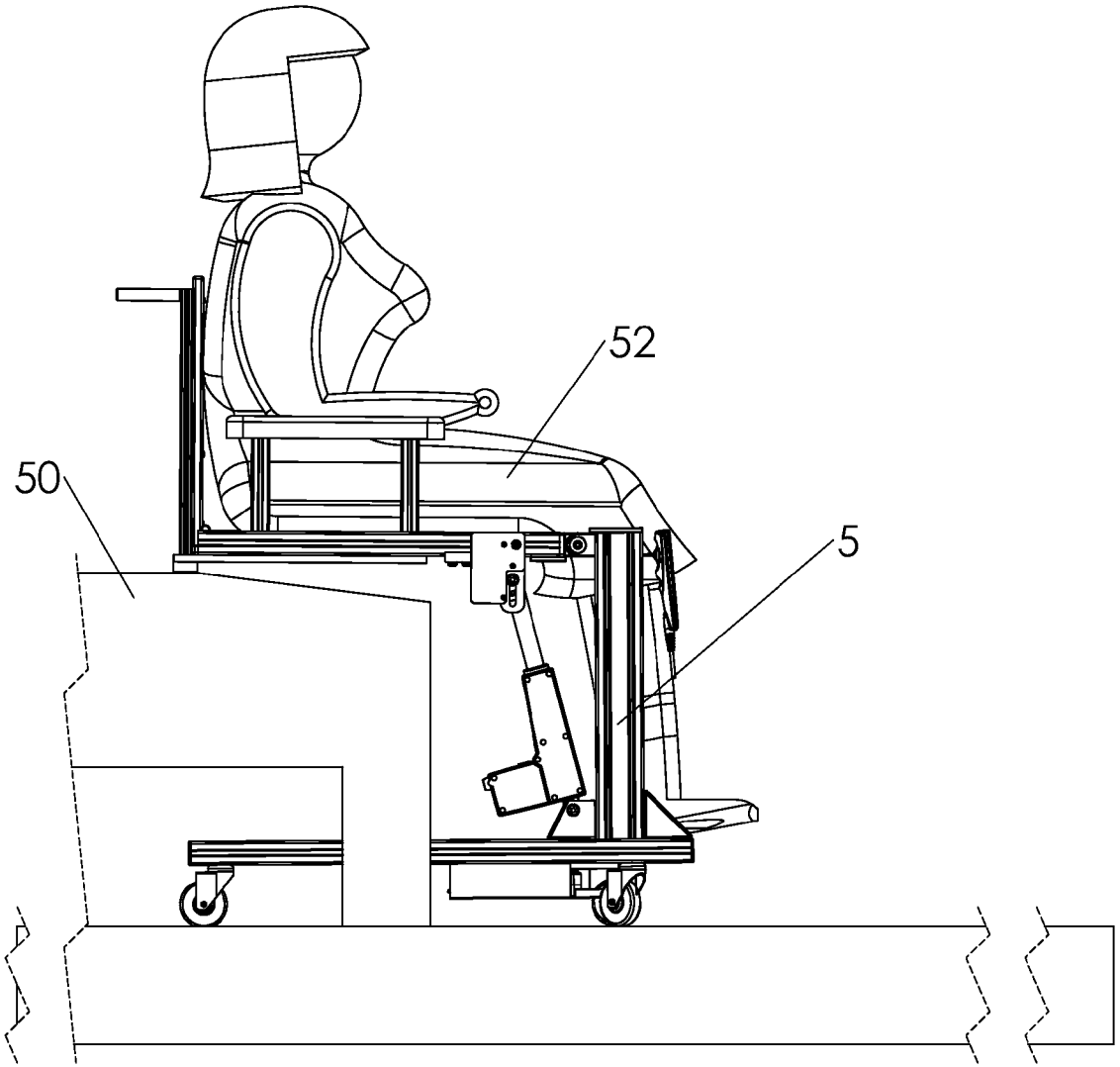
FIG. 8 is a side view of the wheelchair of FIG. 1A with the seat mounted thereon and being lifted off the bed.

As shown in FIG. 8, once the seat 20 is secured to the side profiles 18, the adjusting mechanism 30 can be activated to lift the side profiles 18 together with the seat 20, thereby lifting the patient 50 off the bed 52. The height of the side profiles 18 can be further adjusted until reaching the desired height and angle with respect to the floor, and the rest of the wheelchair frame 10.

It is appreciated that the wheelchair according to the presently disclosed subject matter allows moving a patient from the wheelchair to a bed or any other surface. Moving the patient from the wheelchair to the bed can be carried out substantially in a reverse order to the order in which a patient is moved from a bed to the wheelchair as described hereinabove. That is to say, the wheelchair is brought over the bed, the removable seat is lowered to the bed's height, by activating the adjusting mechanism, and once the removable seat rest on the bed, the mount portions are dismounted from the corresponding frame mounting elements.

A safety mechanism can be provided for precluding an undesired activation of the lifting device 35. For example distance sensors can be coupled to the controller preventing retraction of the lifting device 35 and downwardly displacement of the seat in a position where the seat is not positioned over a bed.

Figure 9A:
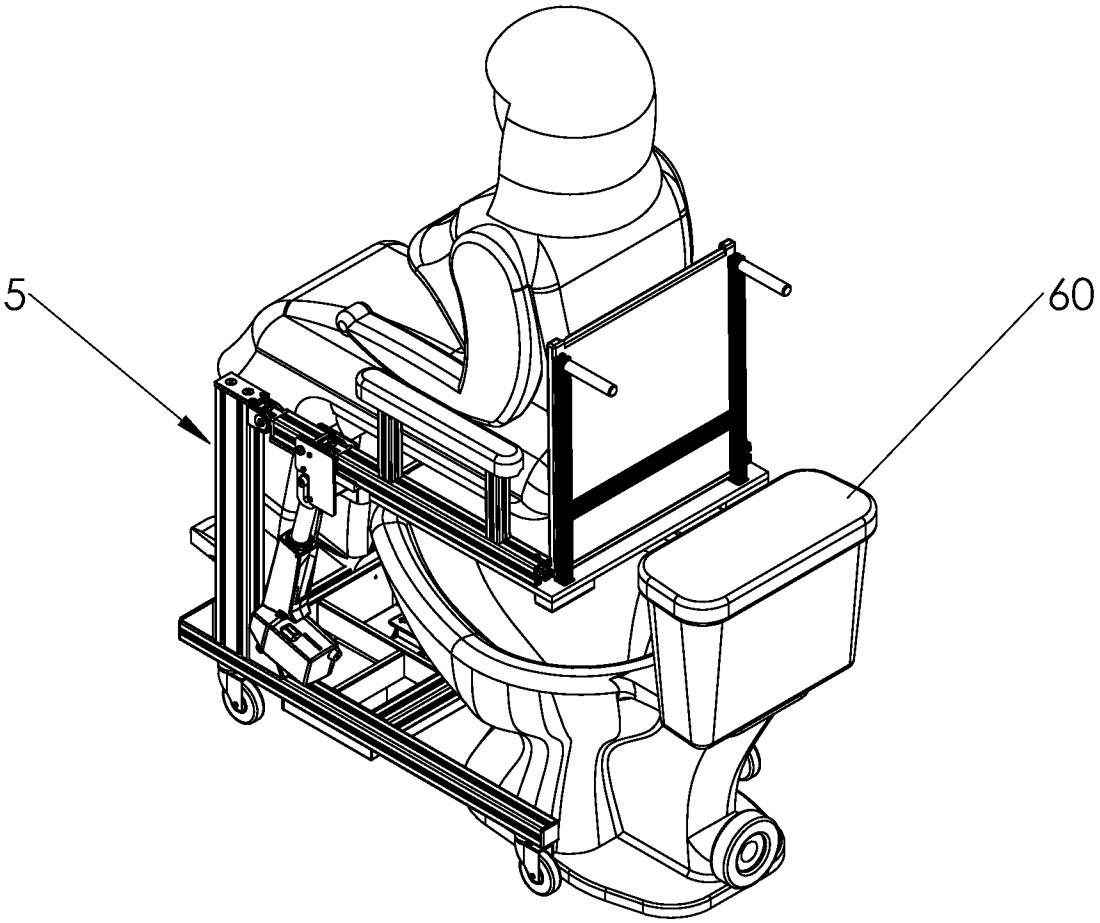
FIG. 9A is a side perspective view of the wheelchair of FIG. 1A positioned over a toilet.
Figure 9B:
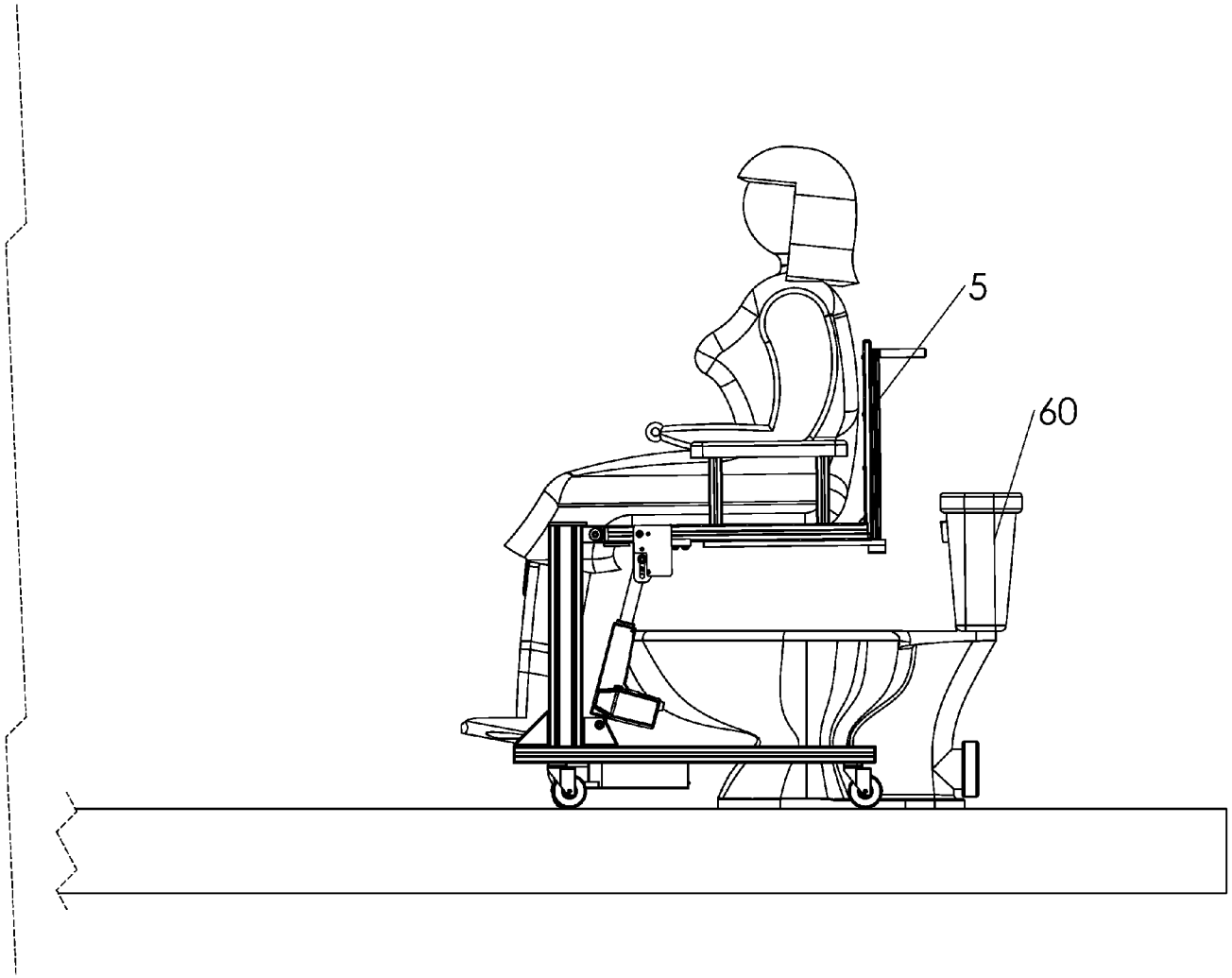
FIG. 9B is a side view of the wheelchair of FIG. 1A positioned over a toilet; and, FIG. 9C is a rear view of the wheelchair of FIG. 9B.
Figure 9C:
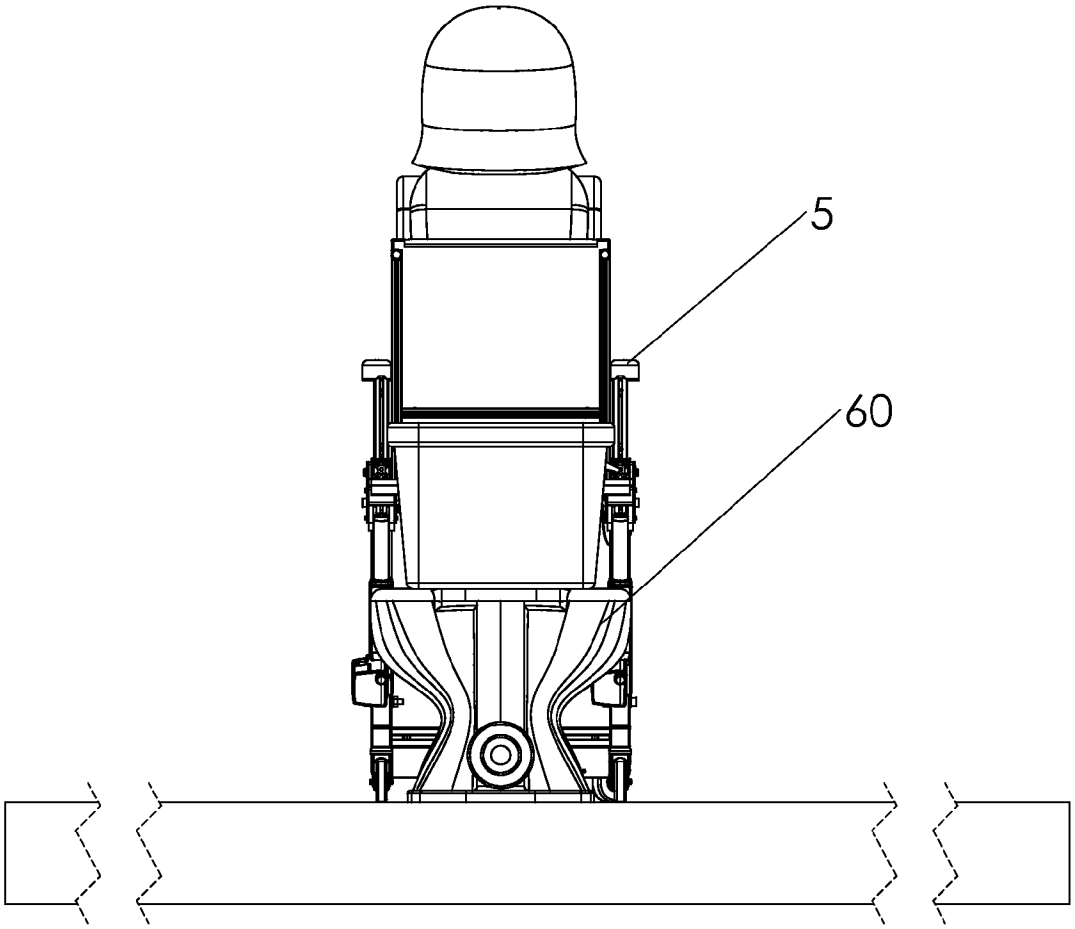

As shown in FIGS. 9A and 9B the wheelchair frame can be designed such that it can be utilized to position a patient over a toilet 60. It is understood that accordingly the seat includes a middle opening. In order to allow positioning of the wheelchair 5 over the toilet 60 the base 14 includes an opened backward portion 65 allowing moving the wheelchair over the toilet 60.

Although in the illustrated example the adjusting mechanism is disposed on the frame such the mounting element of the frame can be adjusted with the corresponding mounting element on the seat, according to other examples the adjusting mechanism can be disposed on the seat and can be configured to adjust the rigid mount portion with respect to the mounting element coupled to the frame.

According to one example of the presently disclosed subject matter the back support can be fixed to the frame and can be configured to rotate sidewardly so as to allow brining the frame adjacent the seat while the patient is sited thereon.

Those skilled in the art to which the presently disclosed subject matter pertains will readily appreciate that numerous changes, variations, and modifications can be made without departing from the scope of the invention, mutatis mutandis.

The invention claimed is:

1. A wheelchair having a frame and wheels mounted thereto, the wheelchair comprising:

a removable seat having a rigid mount portion comprising two bar profiles extending along two sides of the seat;

a frame mounting element configured for being rigidly coupled to the frame, and comprising two side profiles, each having a track thereon configured for rigidly coupling to a corresponding bar profile of said mount portion, allowing thereby coupling of the seat to the frame;

an adjusting mechanism comprising a connector member, a first end thereof is pivotally coupled to a vertical post of the frame by a first hinge, a second end thereof is pivotally coupled to said side profiles, the adjusting member being coupled to said frame mounting element for adjusting the disposition thereof with respect to said mount portion; and an automatic lifting device coupled to said connector member and configured for vertically pivoting thereof about said first hinge, wherein said adjusting mechanism further comprises a coupler extending downwardly from said connector member and slidably coupled to said lifting device thus providing said connector member with additional freedom to pivot up and down with respect to said vertical post, wherein said coupler is a plate having a groove defined thereon, and wherein said lifting device is coupled to a bolt slidably mounted inside said groove.

2. The wheelchair according to claim 1, wherein said adjusting mechanism is configured to allow vertical movement of said side profile with respect to the frame.

3. The wheelchair according to claim 1, wherein said adjusting mechanism is configured to allow upward pivoting of said side profile with respect to the frame thereby adjusting the angle of said side profile with respect to said rigid mount portion.

4. The wheelchair according to claim 3, wherein said frame comprises a vertical post and wherein said side profile is configured to vertically slide up and down along said vertical post.

5. The wheelchair according to claim 1, wherein said adjusting mechanism further comprises a stop member configured to limit the downwardly pivoted movement of said frame mounting element.

6. The wheelchair according to claim 1, wherein said frame mounting element is configured to rotate sidewardly about the axis thereof.

7. The wheelchair according to claim 6, wherein said frame mounting element is further configured to pivot sidewardly.

8. The wheelchair according to claim 1, wherein said rigid mount portion comprises a first and a second mount portions, one on each side of said seat;

and wherein said frame mounting element comprises a first and a second mounting element each rigidly coupled to one side of the frame;

and wherein said adjusting mechanism comprises a first adjusting mechanism for adjusting the disposition of said first mounting element with respect to said first mount portion, and a second adjusting mechanism for adjusting the disposition of said second mounting element with respect to said second mount portion.

9. The wheelchair according to claim 8, wherein said first and second adjusting mechanisms are configured for synchronous operation with one another.

10. The wheelchair according to claim 8, further comprising a controller for controlling the synchronous operation of the first and second adjusting mechanisms.

11. The wheelchair of claim 9, wherein said disposition of said first mounting element with respect to said first mount portion is different than said disposition of said second mounting element with respect to said second mount portion.

12. The wheelchair according to claim 1, further comprising a removable back support.

13. The wheelchair according to claim 1, wherein said lifting device is an electrical linear actuator.

* * * * *